US006527528B1

(12) United States Patent
Barito et al.

(10) Patent No.: US 6,527,528 B1
(45) Date of Patent: Mar. 4, 2003

(54) SCROLL COMPRESSOR WITH CONTROLLED FLUID VENTING

(75) Inventors: Thomas R. Barito, Arkadelphia, AR (US); Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/977,627

(22) Filed: Oct. 15, 2001

(51) Int. Cl.[7] ..... F04C 18/04
(52) U.S. Cl. ..... 418/55.5; 418/57
(58) Field of Search ..... 418/55.5, 57

(56) References Cited

U.S. PATENT DOCUMENTS 5,249,941 A * 10/1993 Shibamoto ..... 418/55.5
6,077,057 A * 6/2000 Hugenroth et al. ..... 418/57

FOREIGN PATENT DOCUMENTS

DE 2338808 * 2/1974 ..... 418/55.5

* cited by examiner

*Primary Examiner*—John J. Vrablik
(74) *Attorney, Agent, or Firm*—Carlson, Gaskey & Olds

(57) ABSTRACT

A scroll compressor is provided with a valve plate which selectively blocks communication between a tap and the back pressure chamber. The valve plate is configured such that it blocks communication during portions of the orbiting cycle and allows communication at other portions. In this way, a scroll compressor designer is able to select the portions of the compression cycle at which refrigerant is delivered to the back pressure chamber. A more consistent and stable operation of the scroll compressor can thus be achieved.

21 Claims, 3 Drawing Sheets

SCROLL COMPRESSOR WITH CONTROLLED FLUID VENTING

BACKGROUND OF THE INVENTION

This invention relates to a method of controlling the venting of a pressurized fluid to a back pressure chamber.

Scroll compressors are becoming widely utilized in refrigerant compression applications. In a scroll compressor, a pair of scroll members each have a base and a generally spiral wrap extending from the base. The wraps interfit to define compression chambers. One of the two scroll members is driven to orbit relative to the other, and as the two orbit, a fluid entrapped between the wraps is compressed.

Scroll compressors are becoming widely utilized due to several benefits. However, scroll compressors also present design challenges. One main design challenge is the creation of a so-called separating force. As the two scroll members compress the entrapped refrigerant, the trapped refrigerant creates a force trying to separate the two scroll members. This force has an axial component tending to move the two scroll members away from each other. If the two scroll members do move relative to each other, then their wraps will come out of contact with the base of the other scroll member, and a fluid seal will be lost.

To address this separating force scroll compressor designers have tapped a pressurized fluid to a chamber behind one of the two scroll members to resist the separating force. This force, known as a back pressure force, biases the two scroll members together in opposition to the separating force.

Typically, a tap is formed through one of the two scroll members, to tap the compressed refrigerant to the chamber. It is known that the pressure within any one compression chamber will vary during an operational cycle of a scroll compressor between intermediate and higher pressures. As this occurs, the magnitude of the back pressure force varies. The variation in the back pressure force can be seen as a pulsation. The pulsating back pressure force results in unstable operation of the compressor. This problem becomes more acute as the pressure ratios increase.

It has thus been proposed in U.S. Pat. No. 5,762,483 to have a pressure tap which is selectively closed by the wrap of the opposed scroll member such that the scroll compressor designer can select what portions of the operational cycle are tapped into the back pressure chamber. In this fashion, the scroll compressor designer can minimize or even eliminate the pulsations, and have better control over the pressure existing in the back pressure chamber.

It would be desirable to provide other ways of achieving this control over the back pressure.

SUMMARY OF THE INVENTION

In the disclosed embodiment of this invention, the tap for tapping a refrigerant from a compression chamber is selectively closed by a portion associated with the housing member such that refrigerant tapping only occurs during selected portions of the orbiting cycle. This device allows the designer to effectively "customize" the back chamber characteristics by sampling intermediate pressure gas from only selected portions of the compression cycle.

More preferably, the tap is through the orbiting scroll, and the crankcase which supports the orbiting scroll carries a component which selectively opens and closes the tap to communicate with the back pressure chamber. The structure is preferably a valve plate which is biased away from the crankcase and into contact with the rear face of the orbiting scroll. The component has a surface which blocks the tap from communicating with the back pressure chamber during selected portions of the orbiting cycle. More preferably, the plate also has other undercut or recessed portions which will allow refrigerant to move through the tap and into the back pressure chamber.

The component is preferably biased into the base of the orbiting scroll to achieve this control. The bias can be achieved by spring force, magnetic force, or other forces.

In one embodiment, the plate would have a location such that it will block flow over portions of the orbiting cycle, but will not be aligned with the tap during other portions. In this fashion, the tailored control of the fluid being delivered to the back pressure chamber can be easily received.

Preferably, some feature is provided to ensure that the plate is properly positioned relative to the tap. Thus, if the plate is asymmetric, some anti-clocking feature is provided. Alternatively, the plate may be designed to be generally symmetric, such as concentric, and no anti-clocking feature will be necessary.

These and other features of the present invention can be best understood from the following specification and drawings, the following of which is a brief description.

DETAILED DESCRIPTION OF A PREFERRED EMBODIMENT

Figure 1A:
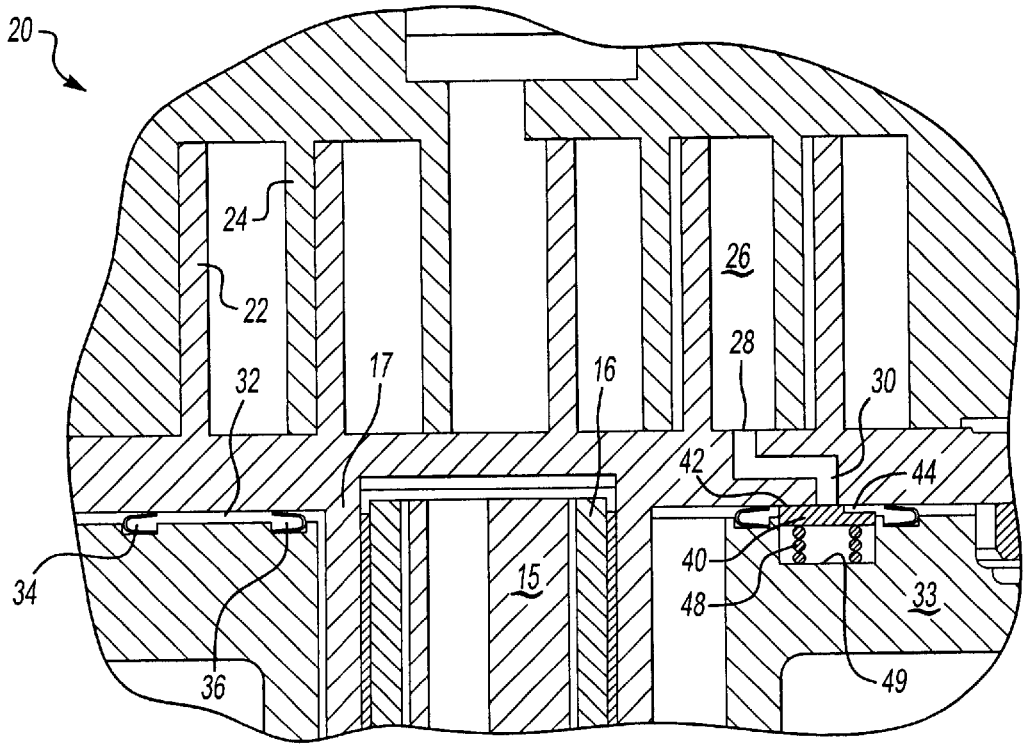
FIG. 1A is a cross-sectional view through a scroll compressor incorporating this invention.

A scroll compressor 20 is illustrated in FIG. 1A having an orbiting scroll 22 and a non-orbiting scroll 24. As is known, the wraps of the orbiting and non-orbiting scroll define compression chambers 26. A fluid tap 28 communicates with the chamber 26 and taps the entrapped refrigerant to an outlet port 30. Outlet port 30 delivers the refrigerant to a back pressure chamber 32 defined between an outer seal 34 and an inner seal 36. As is shown, a shaft 15 extends upwardly into a slider block 16 which is in turn received in a bore 17 in the orbiting scroll to cause the orbiting scroll to orbit when the shaft 15 is driven to rotate. This structure is as known in the art.

The inventive aspects of this application are directed to a valve plate 40 having a higher portion 42 closing off the port 30 and lower portions 44 which will allow flow outwardly of the port 30 into the back pressure chamber 32. A second portion 46 which can be seen in FIG. 2, communicates with the tap 30 during a portion of the cycle of the orbiting scroll.

As further shown, a spring 48 is placed within a chamber 49 to bias the valve 40 into the rear of the base of the orbiting scroll 22.

Figure 1B:
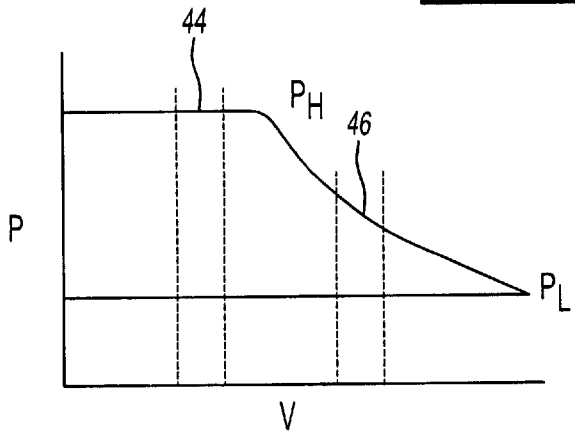
FIG. 1B graphically shows the pressure selection provided by this application.
Figure 2:
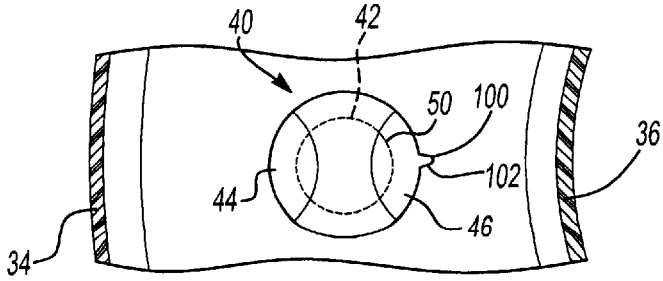
FIG. 2 is a top view of the valve according to the present invention.

As shown in FIG. 1B, the pressure varies across the cycle of movement of the orbiting scroll. The portions 44 and 46 are selectively positioned to tap a portion of the pressure which is at desired locations. Thus, by positioning the portions 44 and 46 at desired locations, a scroll compressor designer is able to achieve desired details of the control. As can be seen in FIG. 2, the tap 30 moves through an orbiting path 50 such that it sequentially communicates with the areas 44, 42 and 46. During this movement, fluid is tapped to the back pressure chamber when the path 50 is over the areas 44 and 46.

As shown in FIG. 1A, the tap 30 is closed. This figure occurs during a portion of the cycle 50 wherein the tap is aligned with the area 42.

Figure 3:
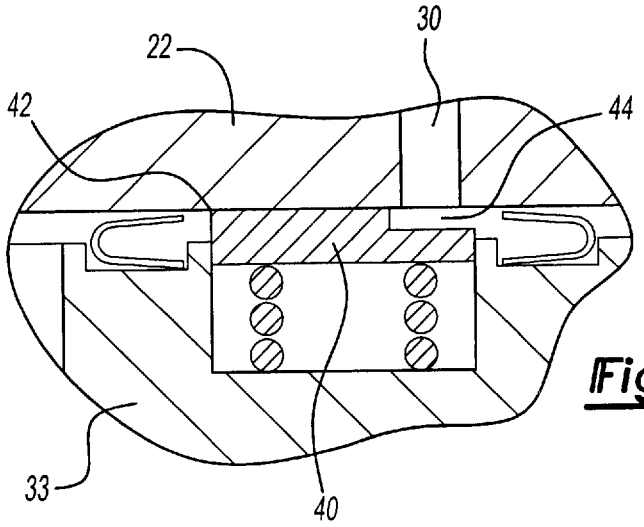
FIG. 3 is a detailed view of the valve in a position other than that shown in FIG. 1.

As shown in FIG. 3, the tap 30 is now aligned with the portion 44. Fluid may now move from the high pressure position shown at 44, and into the back pressure chamber.

Figure 4:
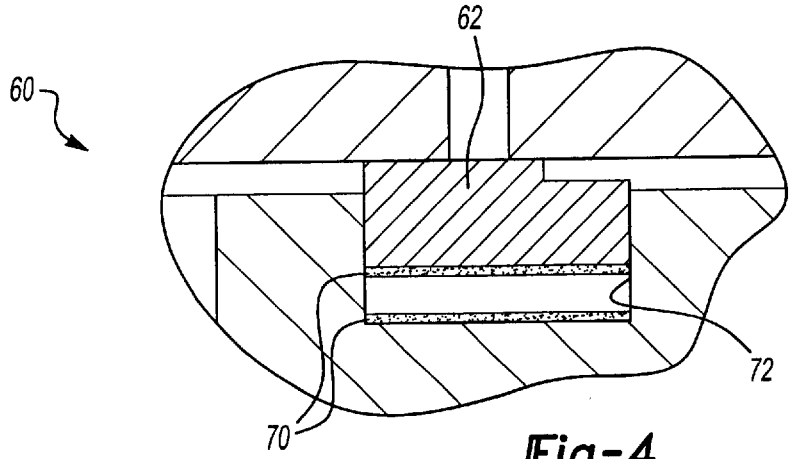
FIG. 4 shows another embodiment.

FIG. 4 shows a magnetically biased embodiment 60 wherein the plate 62 has structure similar to the plate 40. However, plate 62 is biased by a magnetic force against the scroll member 22. As an example, a magnet 70 could be placed within the cavity 72 and acts to bias the valve plate 62 against the orbiting scroll 22.

As shown in FIG. 2, a tab 100 may extend radially outwardly of a portion of the plate 40 and be received at an opening 102, such as in the crankcase. The tab 100 will ensure the plate is properly positioned relative to the tap, and that as the orbiting scroll moves relative to the plate, there will be no "clocking" or twisting movement of the plate which could change the location of the cut-out portions relative to the pressures within the chambers 26.

Figure 5:
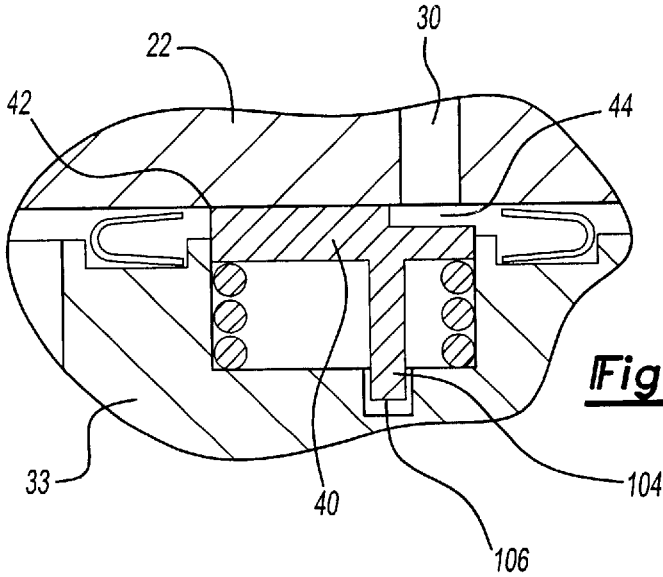
FIG. 5 shows an alternative feature.

FIG. 5 shows an alternative anti-clocking feature 104 which extends downwardly from the plate 40 into an opening 106 in the crankcase.

Figure 6A:
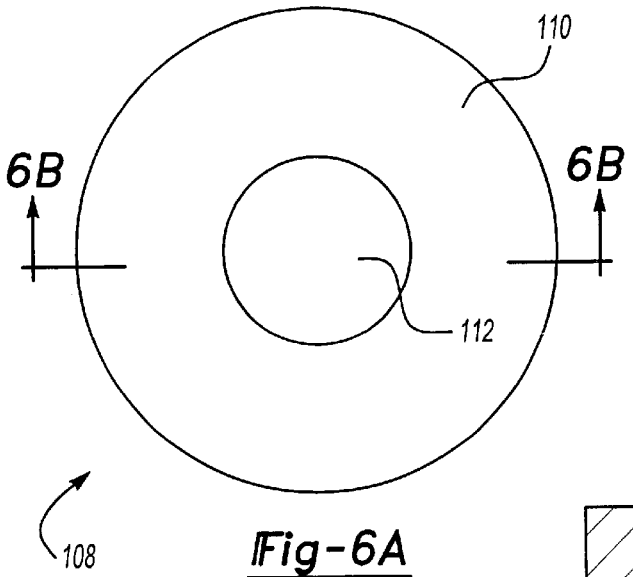
FIG. 6A shows an alternative embodiment.
Figure 6B:
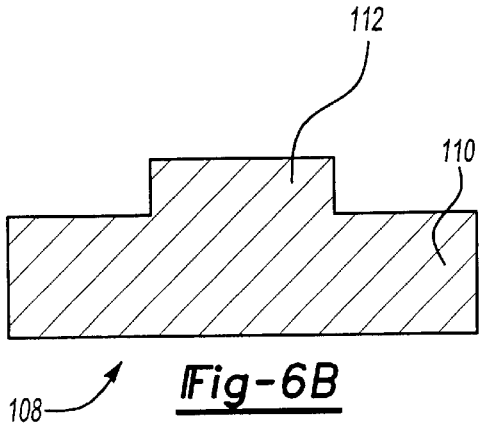
FIG. 6B shows a cross-section to the FIG. 6A embodiment.

FIG. 6A shows an embodiment 108 which is symmetric and in fact concentric. This embodiment has higher portions 112 that will block flow from the tap 30 and a lower portion 110 which will allow flow. By carefully positioning these two surfaces relative to the tap 30, the scroll designer can ensure the desired pressures are obtained into the back pressure chamber. However, since the plate 108 is concentric, no anti-clocking feature is necessary. FIG. 6B is a cross-sectional view through the FIG. 6A embodiment.

Figure 7A:
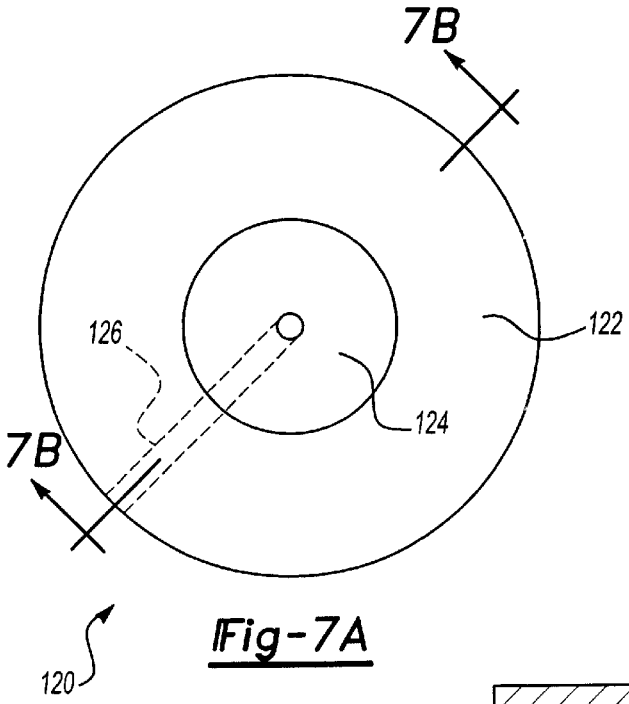
FIG. 7A shows an alternative embodiment.
Figure 7B:
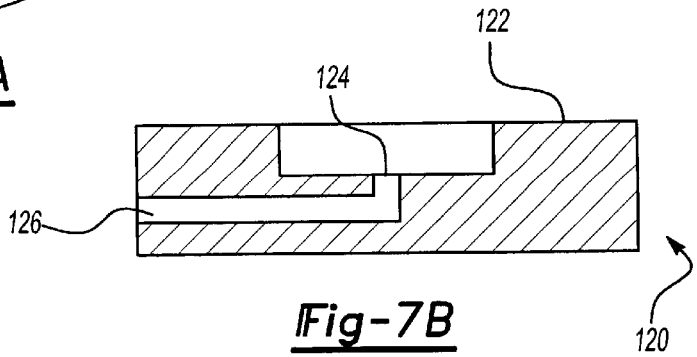
FIG. 7B is a cross-section to the FIG. 7A embodiment.

FIG. 7A shows another embodiment 120 wherein the cut-out portion 124 is positioned inwardly of the higher portion 122. Again, when the tap 30 is aligned with the portion 124, refrigerant from the compression chambers can flow into the back pressure chamber. FIG. 7B is a cross-sectional view through the FIG. 7A embodiment. Notably, a small passage 126 may communicate from the cut-out 124 to the back pressure chamber.

Figure 8:
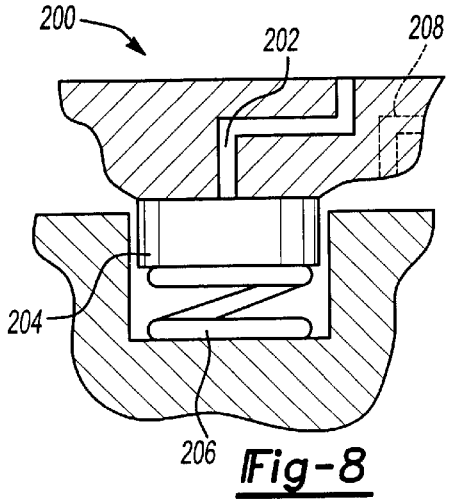
FIG. 8 shows yet another embodiment.

As shown in FIG. 8, another embodiment 200 incorporates a tap 202 which is selectively aligned with a plate 204 which blocks flow from the tap 202. In this embodiment, the orbiting cycle of the tap 202 is such that it will reach a position such as shown at 208 in phantom. At that position, the plate will no longer block flow. This embodiment allows the tailoring of the fluid delivered into the back pressure chamber by positioning the plate to completely block flow over portions of the operational cycle. As shown in this embodiment, the plate is biased by a spring 206, however, the other ways of biasing the plate shown in other embodiments in this application can also be incorporated with this embodiment.

Although preferred embodiments to this invention have been disclosed, a worker in this art would recognize that various modifications would come within the scope of this invention. For that reason, the following claims should be studied to determine the true scope and content of this invention.

We claim:

1. A scroll compressor comprising:

a first scroll member having a base in a generally spiral wrap extending from said base, and a second scroll member having a base in a generally spiral wrap extending from its base, said spiral wraps of said first and second scroll members interfitting to define compression chambers;

at least one of said first and second scroll members being supported within a stationary housing member, and a back pressure chamber defined between a rear of said base of said at least one scroll member and a forward face of said housing member, said forward face being closely spaced from said rear of said base of said at least one scroll member, and a tap extending through said base of said at least one scroll member to tap fluid from a compression chamber into said back pressure chamber; and a component mounted within a cavity extending into said forward face of said housing member, said component being biased against the rear of said base of said at least one scroll member to selectively close said tap during at least portions of an orbiting cycle of said scroll compressor, but to allow refrigerant to move from said tap into said back pressure chamber during other portions of the cycle to allow controlled venting of refrigerant from said compression chambers into said back pressure chamber.

2. A scroll compressor as recited in claim 1, wherein said at least one scroll member is an orbiting scroll which is driven to orbit relative to the other.

3. A scroll compressor as recited in claim 2, wherein said housing is a crankcase.

4. A scroll compressor as recited in claim 3, wherein said component is a valve plate is movable axially within said cavity towards and away from said base of said at least one scroll member.

5. A scroll compressor as recited in claim 4, wherein said valve plate is spring biased towards said rear of said base of said first scroll member.

6. A scroll compressor as recited in claim 4, wherein said plate is magnetically biased towards said rear of said base of said at least one scroll member.

7. A scroll compressor as recited in claim 4, wherein said valve plate selectively blocks said tap over a portion of the orbiting cycle, but is spaced from said tap during said other portions of said cycle.

8. A scroll compressor as recited in claim 4, wherein said plate is asymmetric, and an anti-cocking feature is provided to ensure said plate is properly positioned relative to said tap.

9. A scroll compressor as recited in claim 8, wherein said anti-clocking feature is a pin which extends downwardly into an opening in said housing member.

10. A scroll compressor as recited in claim 8, wherein said anti-clocking feature is a tab extending radially outwardly from said plate and received in a groove in said housing member.

11. A scroll compressor as recited in claim 10, wherein said plate is circular.

12. A scroll compressor comprising:

a first scroll member having a base in a generally spiral wrap extending from said base, and a second scroll member having a base in a generally spiral wrap extending from its base, said spiral wraps of said first and second scroll members interfitting to define compression chambers;

at least one of said first and second scroll members being supported within a housing member, and a back pressure chamber defined between a rear of said base of said at least one scroll member and its associated housing, and a tap extending through said base of said at least one scroll member to tap fluid from a compression chamber into said back pressure chamber;

a component mounted within said housing member, said component being biased against the rear of said base of said at least one scroll member to selectively close said tap during at least portions of an orbiting cycle of said scroll compressor, but to allow refrigerant to move from said tap into a back pressure chamber during other portions of the cycle to allow controlled venting of refrigerant from said compression chambers into said back pressure chamber;

said at least one scroll member is an orbiting scroll which is driven to orbit relative to the other;

said housing is a crankcase;

said crankcase includes a cavity and a valve plate is movable axially within said cavity towards and away from said base of said at least one scroll member; and said component is said valve plate having a surface facing said rear of said base of said first scroll member which provides the selective venting through cut-out portions.

13. A scroll compressor comprising:

a first scroll member having a base and a generally spiral wrap extending from said base, and a second scroll member having a base and a generally spiral wrap extending from its base, said second scroll member being driven to orbit relative to said first scroll member, and compression chambers defined between said wraps of said first and second scroll members decreasing in volume as said second scroll member is driven to orbit relative to said first;

a tap extending through said base of said second scroll member to communicate refrigerant from at least one of said compression chambers to a back pressure chamber defined on a rear of said base of said second scroll member; and a stationary crankcase receiving said second scroll member, said crankcase having a forward face spaced closely behind a rear face of said base of said second scroll member to define said back pressure chamber, said crankcase having a cavity extending into said forward face of said crankcase, said cavity receiving a valve plate which is biased against a rear of said base of said second scroll member, said valve plate having a surface which selectively blocks said tap from communicating refrigerant into said back pressure chamber, but allows communication of said compression chamber into said back pressure during portions of an orbiting cycle of said second scroll member.

14. A scroll compressor as recited in claim 13, wherein said valve plate has two cut-out portions to be aligned with two portions of said orbiting cycle of said second scroll member.

15. A scroll compressor as recited in claim 13, wherein said valve plate is spring biased towards said rear of said base.

16. A scroll compressor as recited in claim 13, wherein said valve plate is magnetically biased towards said rear of said base.

17. A scroll compressor as recited in claim 13, wherein said valve plate is circular.

18. A scroll compressor as recited in claim 13, wherein said valve plate is positioned to block said tap during portions of the orbiting cycle, but is located such as to be spaced from said tap during said portions at which flow is allowed from said tap into said back pressure chamber.

19. A scroll compressor comprising:

a first scroll member having a base in a generally spiral wrap extending from said base, and a second scroll member having a base in a generally spiral wrap extending from its base, said second scroll member being driven to orbit relative to said first scroll member, and compression chambers defined between said wraps of said first and second scroll member decreasing in volume as said second scroll member is driven to orbit relative to said first;

a tap extending through said base of said second scroll member to communicate refrigerant from at least one of said compression chambers to a back pressure chamber defined on a rear of said base of said second scroll member; and a crankcase receiving said second scroll member, said crankcase having a cavity, said cavity receiving a valve plate which is biased against a rear of said base of said second scroll member, said valve plate having a surface which selectively blocks said tap from communicating refrigerant into said back pressure chamber, but allows communication of said compression chamber into said back pressure during portions of an orbiting cycle of said second scroll member; and said valve plate is asymmetric and an anti-clocking feature ensures said valve plate is properly positioned within said crankcase.

20. A scroll compressor as recited in claim 19, wherein said anti-clocking feature is a member extending radially outwardly from said plate and received in a groove in said crankcase.

21. A scroll compressor as recited in claim 19, wherein said anti-clocking feature is a pin extending downwardly from said valve plate and into an opening in said crankcase at a bottom of said cavity.

* * * * *

UNITED STATES PATENT AND TRADEMARK OFFICE

CERTIFICATE OF CORRECTION

PATENT NO. : 6,527,528 B1
DATED : March 4, 2003
INVENTOR(S) : Barito et al.

It is certified that error appears in the above-identified patent and that said Letters Patent is hereby corrected as shown below:

Column 4,
Line 56, “anti-cocking” should be -- anti-clocking --.

Signed and Sealed this

Sixth Day of May, 2003

JAMES E. ROGAN
*Director of the United States Patent and Trademark Office*